US005377088A

United States Patent [19]

Lecluze

[11] Patent Number: 5,377,088

[45] Date of Patent: Dec. 27, 1994

[54] LIGHT FIXTURE FOR MOUNTING TO A CEILING, WALL OR THE LIKE

[76] Inventor: Michel Lecluze, 1009 rue du Parc Industriel, St.-Jean-Chrysostome, Qûebec, Canada, G6Z 1C5

[21] Appl. No.: 25,767

[22] Filed: Mar. 3, 1993

[51] Int. Cl.[5] ..... F21S 1/06

[52] U.S. Cl. ..... 362/366; 362/365; 362/396; 248/343

[58] Field of Search ..... 362/147, 148, 365, 366, 362/396; 248/343, 313, 311.3

[56] References Cited

U.S. PATENT DOCUMENTS 4,048,491 9/1977 Wessman ..... 248/343 XR
4,673,149 6/1987 Grote et al. ..... 362/366 XR
4,733,339 3/1988 Kelsall ..... 362/366
5,068,772 11/1991 Shapiro et al. ..... 248/343 XR

*Primary Examiner*—Stephen F. Husar
*Attorney, Agent, or Firm*—Joseph Scafetta, Jr.

[57] ABSTRACT

The disclosure herein describes a light fixture for mounting to a ceiling, wall or the like which comprises a pot having a peripheral edge abutting the area adjacent a hole made in the ceiling or wall. A hook and a bolt extending through appropriate openings in the inner wall and the side wall of the pot cooperate to secure the pot to the ceiling. Rotating the bolt causes the hook to move into an abutting engagement with the rear surface of the ceiling, the latter thus being contacted, on the outside, by the peripheral edge of the pot and, on the inside, by that portion of the hook engaging the rear surface of the ceiling.

5 Claims, 2 Drawing Sheets

LIGHT FIXTURE FOR MOUNTING TO A CEILING, WALL OR THE LIKE

FIELD OF THE INVENTION

The present invention pertains to a light fixture for mounting to a ceiling, wall or the like in which a hole has been made to receive the fixture.

BACKGROUND OF THE INVENTION

There are various fastening devices to mount a light fixture, in the form of a pot, to a ceiling or the like. With those using a spring arrangement, the fixing is accomplished inside the hole. Other systems require a metallic plate inside the ceiling which results in an electrician to work inside the ceiling to carry out the mounting operation. Other devices require the provision of a lath to which the pot is fixed. It has been found that, in most cases, to secure the pot to the ceiling often causes some damage to the material of the ceiling.

OBJECTS AND STATEMENT OF THE INVENTION

It is an object of the present invention to overcome present problems of existing systems for fixing a light fixture to a ceiling, wall or the like.

It is also an object of the present invention to provide a mounting device which is easy to use and which may be installed independently of the thickness of the ceiling or wall.

This is achieved by providing a light fixture which comprises:

a pot, having an inner wall and a side wall, adapted to be received rearwardly of the ceiling, the side wall having an outer peripheral flange adapted to bear against the front surface adjacent the opening; the side wall defining slot means therein;

a hook consisting of an elongated body having a main portion adapted to extend through the slot means substantially parallel to the side wall of the pot, the body having a first end portion bent to extend substantially parallel to the inner wall of the pot and a second end portion bent to extend substantially parallel to and rearwardly of the rear surface of the ceiling; the first end portion defining a threaded hole therethrough;

a bolt having a head and an elongated threaded stem adapted to extend through the opening of the inner wall and to engage the threaded hole of the first end portion of the hook whereby rotation of the bolt causes the first end portion to move longitudinally along the stem of the bolt and the second end portion to move to bear against the rear surface of the ceiling to thereby secure the light fixture to the ceiling.

In one form of the invention, the side wall of the pot is provided with two vertically aligned slots through which extend upper and lower parts of the hook.

In a further form of the invention, the lower bent end portion of the hook as an enlarged width relative to that of the rest of the hook to augment the abutting function.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
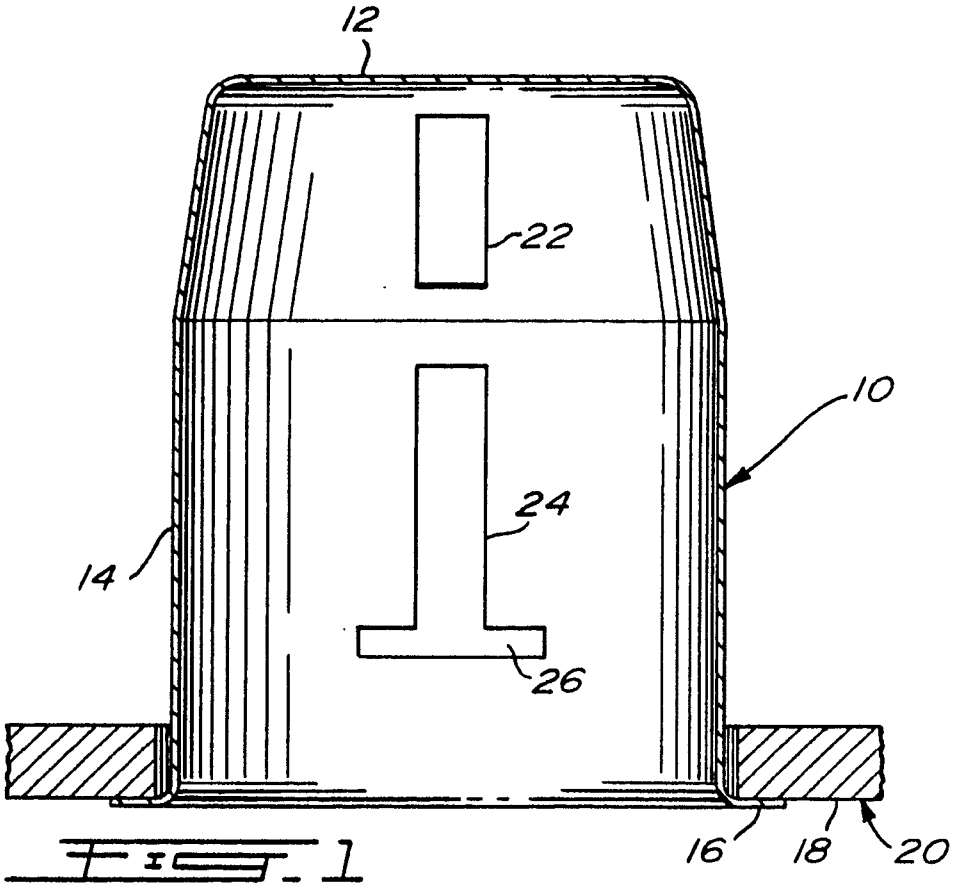
FIG. 1 is a cross-sectional view of a pot forming part of the light fixture made in accordance with the present invention.

Referring to FIG. 1, there is shown a pot 10 having an inner wall 12 and a sidewall 14, the latter having a peripheral outer flange 16 which is adapted to bear against the front surface 18 of a ceiling 20.

Figure 3:
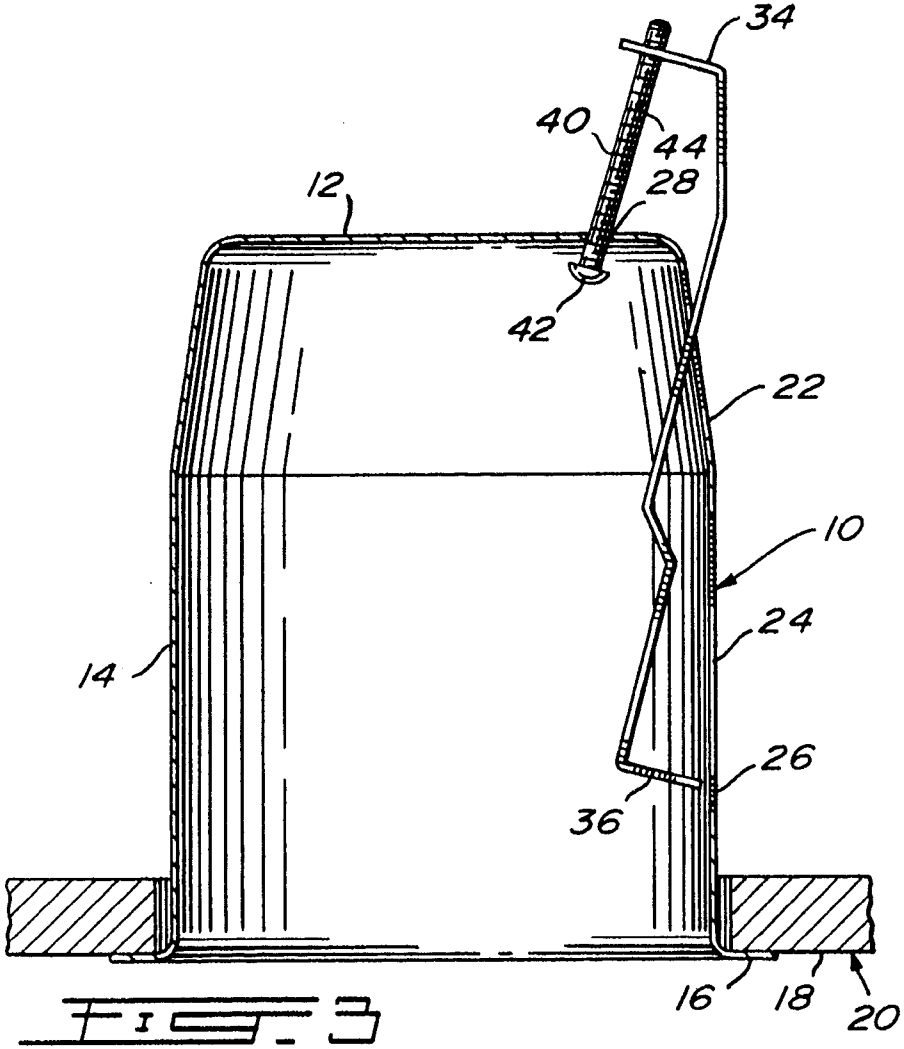

The side wall 14 displays a pair of slots 22 and 24 vertically aligned with respect to one another, the lower slot having an enlarged lower section 26. As can be seen in FIG. 3, the inner wall 12 has an opening 28.

Figure 2:
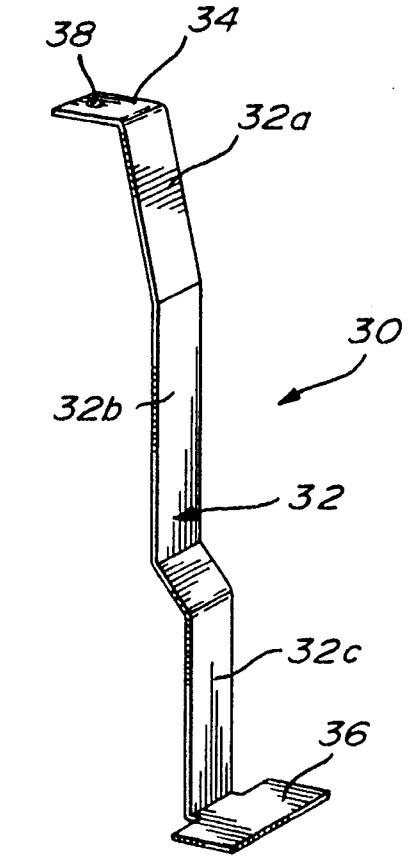
FIG. 2 is a perspective view of a hook forming part of the light fixture of the present invention.

Referring to FIG. 2, a hook, generally denoted 30, defines an elongated rectangular body 32 having, at respective opposite ends thereof, a first bent portion 34 and a second bent portion 36, both extending substantially perpendicular to the main portion of body 32, which consists of an upper part **32*a*, an intermediate part 32*b* and a lower part 32*c***.

Referring to FIG. 3, the light fixture also comprises a bolt 40 having a head 42 and an elongated threaded stem portion 44 which extends through the opening 28 of the inner wall of the pot. This portion 44 threadingly engages hole 38 of the hook.

Figure 4:
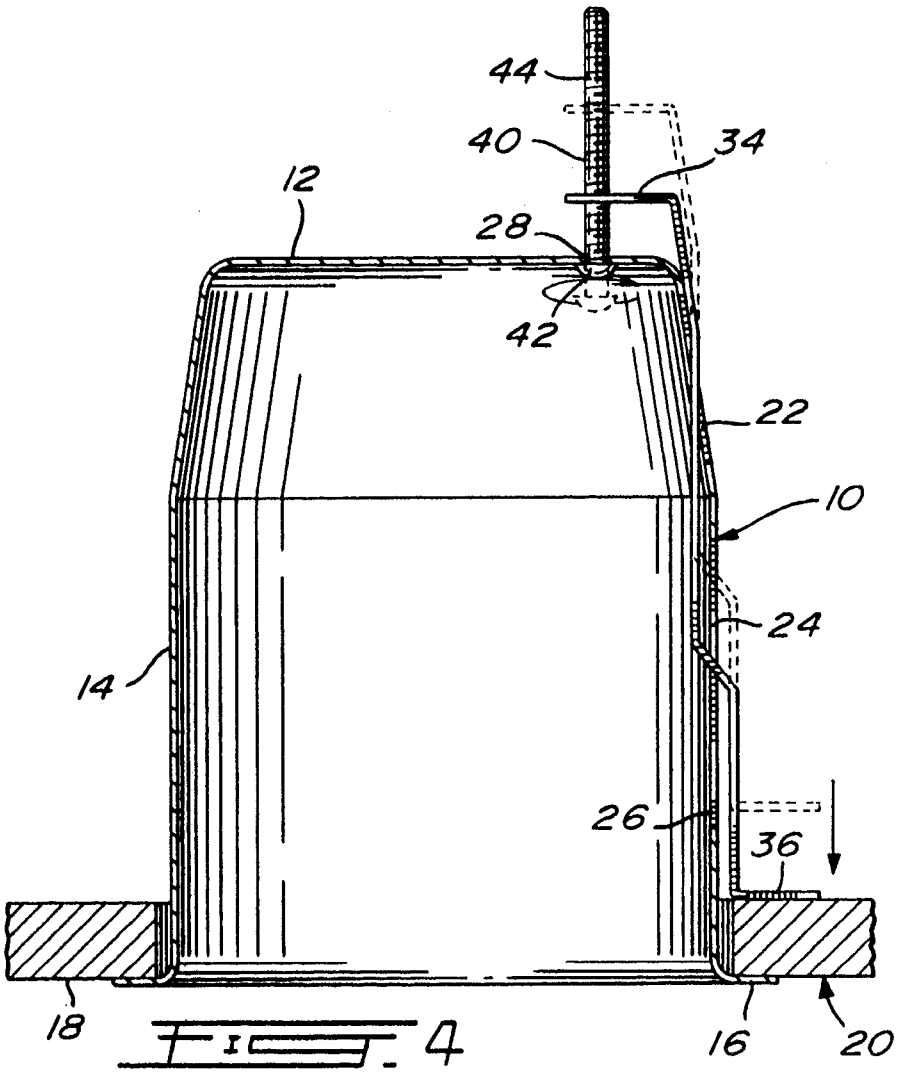
FIGS. 3 and 4 show successive operations for securing the light fixture to a ceiling.

To secure the pot into the opening of the ceiling, the bent portion 34 is inserted into slot 22 while bolt 40 is inserted in opening 28 and is threadedly engaged in hole 38 of the bent portion 34. The lower bent portion 36 is inserted into slot 26 so that parts **32*c* and 32*a* of the hook lie rearwardly of the wall 14 of the pot while part 32*b* extends inside the pot. The bolt is rotated until the hook reaches the position shown in FIG. 4 where the enlarged lower bent portion 36** abuts the rear surface of the ceiling, thus securing the pot in the ceiling opening.

Although the invention has been described above with in relation to one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A light fixture for mounting into an opening made in a ceiling, wall or the like defining a front surface and a rear surface, said fixture comprising:

a pot adapted to be received rearwardly of said ceiling, said pot having an inner wall and a side wall; said side wall having an outer peripheral flange adapted to bear against said front surface adjacent said opening; said side wall defining slot means therein;

a hook consisting of an elongated body having a main portion adapted to extend through said slot means substantially parallel to said side wall of said pot; said body having a first end portion bent to extend substantially parallel to and rearwardly of said inner wall of said pot and a second end portion bent to extend substantially parallel to and rearwardly of said rear surface of said ceiling; said first end portion defining a threaded hole therethrough;

a bolt having a head and an elongated threaded stem adapted to extend through said opening of said inner wall of said pot and to engage said threaded hole of said first end portion of said hook whereby rotation of said bolt causes said first end portion to move longitudinally along said stem of said bolt and said second end portion to move to bear against said rear surface of said ceiling to thereby secure said light fixture to said ceiling.

2. A light fixture as defined in claim 1, wherein said slot means consist of a pair of vertically aligned slots to allow portions of said main portion of said hook to extend frontwardly and rearwardly of said side wall.

3. A light fixture as defined in claim 2, wherein said body of said hook has a rectangular cross-section and a width slightly smaller than that of said slots.

4. A light fixture as defined in claim 3, wherein said second end portion has an enlarged width relative to that of remaining portions of the hook and wherein one of said slots has an enlarged lower section to correspondly receive therethrough said portion having a greater width.

5. A light fixture as defined in claim 2, wherein said main portion of said hook comprises an upper part, and intermediate part and a lower part; said upper and lower parts extending rearwardly of said side wall when mounted to said pot and said intermediate part extending within said pot.

* * * * *